US011674283B2

(12) United States Patent
Li et al.

(10) Patent No.: US 11,674,283 B2
(45) Date of Patent: Jun. 13, 2023

(54) SEMI-SUBMERSIBLE IMMERSED TUBE TRANSPORTATION AND INSTALLATION INTEGRATED SHIP AND CONSTRUCTION PROCESS

(71) Applicant: CCCC FIRST HARBOR ENGINEERING CO., LTD., Tianjin (CN)

(72) Inventors: Yiyong Li, Tianjin (CN); Naishou Zhang, Tianjin (CN); Chuang Du, Tianjin (CN); Zengjun Li, Tianjin (CN); Yuanping Fu, Tianjin (CN); Yuxi Feng, Tianjin (CN); Jianning Zhang, Tianjin (CN)

(73) Assignee: CCCC FIRST HARBOR ENGINEERING CO., LTD., Tianjin (CN)

( * ) Notice: Subject to any disclaimer, the term of this patent is extended or adjusted under 35 U.S.C. 154(b) by 0 days.

(21) Appl. No.: 17/945,094

(22) Filed: Sep. 15, 2022

(65) Prior Publication Data

US 2023/0017526 A1 Jan. 19, 2023

Related U.S. Application Data

(63) Continuation of application No. PCT/CN2021/141976, filed on Dec. 28, 2021.

(30) Foreign Application Priority Data

Apr. 23, 2021 (CN) ..... 202110440615.6

(51) Int. Cl.

| | |
|---|---|
| ***E02D 29/073*** | (2006.01) |
| ***B63B 27/08*** | (2006.01) |
| ***B63B 35/00*** | (2020.01) |

(52) U.S. Cl.

CPC ..... *E02D 29/073* (2013.01); *B63B 27/08* (2013.01); *B63B 35/003* (2013.01)

(58) Field of Classification Search

CPC ..... B63B 35/003; B63B 77/00; B63B 27/08; B63B 27/16; B63B 1/107; E02B 2017/0047; E02D 29/073

See application file for complete search history.

(56) References Cited

U.S. PATENT DOCUMENTS 907,357 A * 12/1908 Hoff ..... E02D 29/073 405/137
928,536 A * 7/1909 Pino ..... B63C 7/04 114/51

(Continued)

FOREIGN PATENT DOCUMENTS

CN 106628018 A 5/2017
CN 106697178 A 5/2017

(Continued)

OTHER PUBLICATIONS

International Search Report of PCT/CN2021/141976.

*Primary Examiner* — Benjamin F Fiorello
(74) *Attorney, Agent, or Firm* — J.C. Patents

(57) ABSTRACT

The present application provides a semi-submersible immersed tube transportation and installation integrated ship and a construction process; the integrated ship includes: a deck structure; two floating structures, ballast water being able to be injected therein; and upper portions or top surfaces of the two floating structures are connected by the deck structure; and two support mechanisms, disposed on opposite sides of the two floating structures respectively; and each support mechanism is disposed at a lower portion or a bottom of the floating structure. The integrated ship can (Continued)

reduce the draught of the integrated ship carrying an immersed tube and realize the transportation requirements of shallow waterway.

14 Claims, 4 Drawing Sheets

(56) References Cited

U.S. PATENT DOCUMENTS 1,060,271 A * 4/1913 McBean et al. ..... E02D 29/067 405/224
3,901,038 A * 8/1975 Olsen ..... E02D 29/073 405/136
5,662,434 A * 9/1997 Khachaturian ..... B63B 27/16 405/209
6,318,931 B1 * 11/2001 Khachaturian ..... B63B 27/10 405/209
8,312,828 B2 * 11/2012 Luo ..... B63B 77/00 405/209
8,496,406 B2 * 7/2013 Hertgers ..... E02D 29/063 405/136
8,708,604 B2 * 4/2014 Luo ..... B63B 77/00 405/196
9,003,988 B2 * 4/2015 Khachaturian ..... B63B 71/00 114/61.18
10,836,459 B2 * 11/2020 Li ..... B63B 1/107
2003/0103812 A1 * 6/2003 Linden ..... B63B 77/00 405/203
2012/0110819 A1 * 5/2012 Perol ..... B63B 77/00 29/700
2013/0045056 A1 2/2013 Meeuws

FOREIGN PATENT DOCUMENTS

CN 206634166 U 11/2017
CN 110053720 A 7/2019
CN 110877666 A 3/2020
CN 112092989 A 12/2020
CN 113148028 A 7/2021
CN 214524328 U 10/2021
JP 09144018 A 6/1997

* cited by examiner

SEMI-SUBMERSIBLE IMMERSED TUBE TRANSPORTATION AND INSTALLATION INTEGRATED SHIP AND CONSTRUCTION PROCESS

CROSS-REFERENCE TO RELATED APPLICATIONS

The present application is a continuation of PCT/CN2021/141976 filed on Dec. 28, 2021, which claims the priority benefit of Chinese application No. 202110440615.6, filed on Apr. 23, 2021, entitled "Semi-Submersible Immersed Tube Transportation and Installation Integrated Ship and Construction Process", and Chinese application No. 202120852963.X, filed on Apr. 23, 2021, entitled "Semi-Submersible Immersed Tube Transportation and Installation Integrated Ship and Construction Process", the entirety of the above identified applications are hereby incorporated by reference.

TECHNICAL FIELD

The present application belongs to the field of underwater tunnel construction technology, and specifically relates to a semi-submersible immersed tube transportation and installation integrated ship and a construction process.

BACKGROUND ART

At present, an immersed tunnel is a common structure for river-crossing tunnels and sea-crossing tunnels at home and abroad. The successful completion of Hong Kong-Zhuhai-Macao Bridge, one of China's mega projects, has promoted the leapfrog development of China's immersed tunnel projects. Following this Project, the construction of mega projects such as Shenzhen-Zhongshan Bridge and Dalian Bay Undersea Tunnel has been commenced one after another.

Special equipments are needed for the transportation and installation of immersed tubes of an immersed tunnel. However, when immersed tubes are transported to shallow area by conventional immersed tube transportation equipment, the environment for transportation cannot meet the draught requirement of the transportation equipment carrying immersed tubes, so that conventional transportation equipment cannot transport immersed tubes to shallow area, and the dredging work is often needed to increase the water depth. In order to improve the construction efficiency and reduce the construction cost, it is necessary to develop a piece of transportation equipment capable of transporting immersed tubes to shallow waterway.

SUMMARY OF THE INVENTION

In view of some shortcomings in the prior art, the present application provides a semi-submersible immersed tube transportation and installation integrated ship and a construction process.

A first aspect of the present application provides a semi-submersible immersed tube transportation and installation integrated ship, including:

a deck structure;

two floating structures, ballast water being able to be injected therein; taking a vertical plane where a centerline of the integrated ship along the length direction is located as a reference plane, the two floating structures are symmetrical and parallel to the reference plane, and upper portions or top surfaces of the two floating structures are connected by the deck structure; and two support mechanisms, disposed on opposite sides of the two floating structures respectively; the two support mechanisms are symmetrical to the reference plane, and each support mechanism is disposed at a lower portion or a bottom of the corresponding floating structure; wherein, each support mechanism further includes:

at least two support assemblies; and drive assemblies each configured to drive the support assembly to abut against or stretch out of the floating structure where the support assembly is located; and the support assemblies are able to support a bottom surface of an immersed tube after stretching out of the floating structures; and the space above the support assemblies, below the deck structure and between the two floating structures constitutes a carrying space for accommodating the immersed tube.

Optionally, each floating structure is internally provided with a cavity structure capable of containing ballast water; and by controlling the quantity of ballast water in the cavity structure, the floating structure is controlled to dive down and float up. Optionally, each floating structure is provided with a ballast water system, and the ballast water system controls the floating structure to dive down and float up by controlling the quantity of ballast water in the cavity structure.

Optionally, each support assembly includes: a support leg with a top surface configured to support the immersed tube, and a rotating shaft disposed vertically and configured to rotationally connect the support leg and the corresponding floating structure; the drive assemblies are arranged in one-to-one correspondence with the support legs to drive the support leg to rotate around the rotating shaft.

Optionally, an end portion of the rotating shaft is connected with the corresponding floating structure through a bearing, and the drive assembly further includes: a hydraulic motor with a body fixedly installed on the floating structure and with a drive shaft disposed vertically, a first gear being coaxially arranged with the drive shaft and being sleeved and fixed on the drive shaft, and a second gear being coaxially arranged with the rotating shaft and being sleeved and fixed on the rotating shaft; the second gear is meshed with the first gear.

Optionally, a sidewall of each floating structure is provided with accommodating grooves; the accommodating grooves are in one-to-one correspondence with the support legs; the rotating shaft is located in the corresponding accommodating groove; and the support leg is able to enter into the accommodating groove by rotating with the rotating shaft.

Optionally, each floating structure is internally provided with sealed electronic compartments for mounting the drive assemblies; and the sealed electronic compartments are in one-to-one correspondence with the drive assemblies.

Optionally, each support leg further includes: a mounting base fixedly installed on a sidewall of the rotating shaft, and a jack with a cylinder bottom fixedly installed on a top surface of the mounting base and with a piston rod disposed vertically upward.

Optionally, a backing plate is fixedly installed on a top surface of the piston rod. Optionally, the backing plate is a rubber plate.

Optionally, the deck structure is fixedly connected with the two floating structures through detachable truss connecting structures. Optionally, each truss connecting structure includes an upper connecting plate connected to the deck structure, a truss structure, and a lower connecting plate connected to the floating structure.

Optionally, the integrated ship further includes a cable system disposed on the deck structure for reinforcing the connection between the immersed tube and the integrated ship.

A second aspect of the present application provides a construction process for an immersed tube transportation and installation, using the above semi-submersible immersed tube transportation and installation integrated ship, including the following steps:

transporting a prefabricated immersed tube in place and winching the immersed tube to a position of a submerged pit;

after the immersed tube in place, moving the integrated ship to a designated position to span above the immersed tube;

injecting ballast water into the floating structures of the integrated ship, so that the two floating structures dive down synchronously to ensure the stable diving of the integrated ship, and the support assemblies keep abutting against the floating structures during the diving process; and ending the diving process after top surfaces of the support assemblies are lower than the bottom surface of the immersed tube;

driving, by the drive assemblies, the support assemblies to stretch out of the floating structures, so that the support assemblies are located below the bottom surface of the immersed tube;

making the two floating structures float up by discharging the ballast water simultaneously, so that the integrated ship floats up steadily; the top surfaces of the support assemblies being gradually in contact with the bottom surface of the immersed tube and bearing force, to support the immersed tube; the integrated ship continues to float up until the integrated ship and the immersed tube as a whole meet the draught requirements of waterways; and the floating structures stop discharging the ballast water out;

towing the integrated ship by tugboats, and the integrated ship driving the immersed tube to synchronously move through friction between the support assemblies and the immersed tube, so as to transport the immersed tube to an immersed tube installation site;

after the integrated ship carrying the immersed tube is anchored in place, injecting ballast water into the floating structures of the integrated ship, so that the integrated ship dives down synchronously and stably with the immersed tube; when the action force between the support assemblies and the immersed tube becomes zero, and after the integrated ship continues to dive down for a distance to ensure that the support assemblies are completely detached from the bottom surface of the immersed tube, stopping injecting ballast water and diving down; disconnecting the immersed tube from the integrated ship; and the drive assembly driving the support assembly to retract and abut against the floating structure; and making the two floating structures float up by discharging the ballast water simultaneously; and after the integrated ship floats up to a normal position stably, adjusting an anchor cable to winch and move the integrated ship; towing the immersed tube to the installation site by a cable system; and steadily lowering the immersed tube down by adjusting the quantity of ballast water of the immersed tube and by adjusting the cable system, to complete the installation of the immersed tube.

Compared with the prior art, the advantages and positive effects of the present application are as below.

At least one embodiment of the present application provides a semi-submersible immersed tube transportation and installation integrated ship and a construction process. The integrated ship can reduce the draft after the ship is loaded with the immersed tube, thus realizes the transportation of immersed tubes in shallow waterway, reduces the amount of dredging in the waterways, effectively reduces construction costs, and improve construction efficiency and economic benefits. More specifically, The integrated ship of at least one embodiment of the present application has a semi-submersible function. During the transportation of one immersed tube, the integrated ship can provide greater buoyancy, and the support mechanisms can support the immersed tube, which can reduce the draught of the integrated ship and the immersed tube as a whole in the transportation process, meet the transportation requirements of shallow waterway, greatly reduce the quantities of dredging work of the waterways, and save the construction cost.

In at least one embodiment of the present application, the support leg of each support mechanism is provided with a jack to support the immersed tube. Leveling is achieved by adjusting the stretching out or retracting back of the piston rods of the jacks of multiple support legs, so as to ensure the even stress between the bottom surface of the immersed tube and all support legs, and avoid the damage to the immersed tube or equipment due to partial uneven stress.

At least one embodiment of the present application uses a truss connection structure to connect the floating structure and the deck structure, which allows easy disassemble and assemble between the two floating structures and the deck structure, facilitates hull transformation, is easy to change the width of hull to adapt to the transportation and installation of immersed tubes of different sizes, and improves the application value of the integrated ship.

Figure 1:
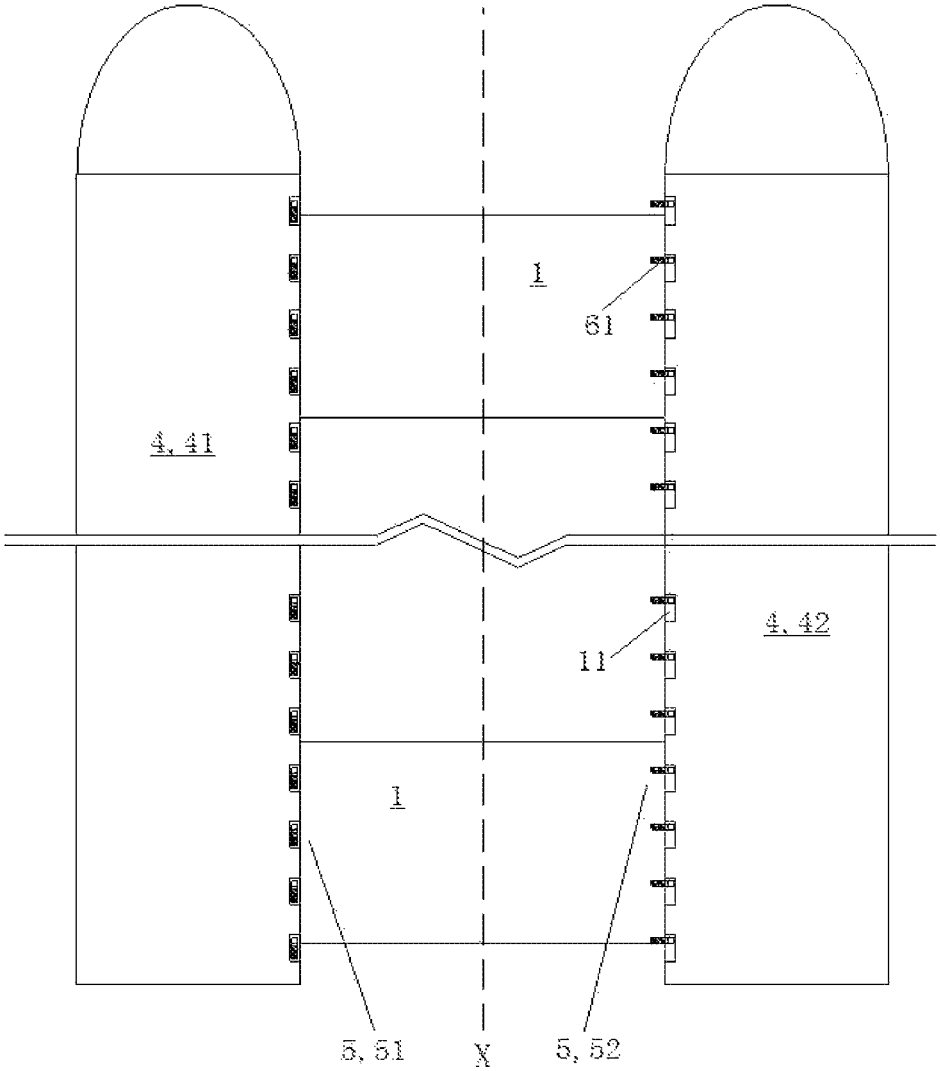
FIG. 1 is a bottom view of an integrated ship according to one embodiment of the present application.

in which: 1 deck structure; 2 immersed tube; 3 tube-ship connecting structure; 4 floating structure; 41 first floating structure; 42 second floating structure; 43 cavity structure; 5 support mechanism; 51 first support mechanism; 52 second support mechanism; 6 support assembly; 61 support leg; 611 mounting base; 612 jack; 613 backing plate; 62 rotating shaft; 7 drive assembly; 71 hydraulic motor; 711 drive shaft; 72 first gear; 73 second gear; 8 carrying space; 9 control unit; 10 pressure sensor; 11 bearing; 12 accommodating groove; 13 sealed electronic compartment; 14 ballast water system; 15 truss connecting structure; 151 upper connecting plate; 152 truss structure; and 153 lower connecting plate.

DETAILED DESCRIPTION OF THE EMBODIMENTS

Technical solutions of the present application will be described in detail below in combination with specific embodiments. However, it should be understood that elements, structures and features in one embodiment may also be advantageously incorporated into other embodiments without further description.

In the description of the present application, it should be noted that terms such as "first" and "second" are used for descriptive purposes only, and cannot be understood as indicating or implying the relative importance, or implicitly indicating the number of indicated technical features. Therefore, the features defined with "first" and "second" may explicitly or implicitly include one or more of these features.

In the description of the present application, it should be noted that the terms "inside", "outside", "left", "right" and the like indicate the positional or positional relationship according to the positional relationship shown in the drawings merely for the convenience of describing the present application and the simplified description, but do not indicate or imply a devices or an element referred to must be of a particular orientation, constructed and operated in a particular orientation and therefore should not be construed as limiting the present application.

In the description of the present application, it should be noted that the terms "connect", "connecting" and "connected" should be understood in a broad sense unless otherwise clearly specified and limited. For example, they might be fixed connection, detachable connection, or integrated connection; might be direct connection or indirect connection through an intermediate medium, and might be internal connection of two elements. For those of ordinary skill in the art, the specific meanings of the above-mentioned terms in the present application can be understood under specific circumstances.

As shown in FIGS. 1 to 6, in a first embodiment of the present application, a semi-submersible immersed tube transportation and installation integrated ship (hereinafter referred to as the integrated ship) is provided, including a deck structure 1, a tube-ship connecting structure 3 for connecting the integrated ship and an immersed tube 2, two floating structures 4 disposed in parallel, and two support mechanisms 5. The two support mechanisms 5 are respectively disposed on two opposite sides of the two floating structures 4, i.e., the two support mechanisms 5 are oppositely disposed. As shown in FIG. 1, a first support mechanism 51 is located on an inner side of a first floating structure 41 and a second support mechanism 52 is located on an inner side of a second floating structure 42, and they are opposite to each other.

Figure 2:
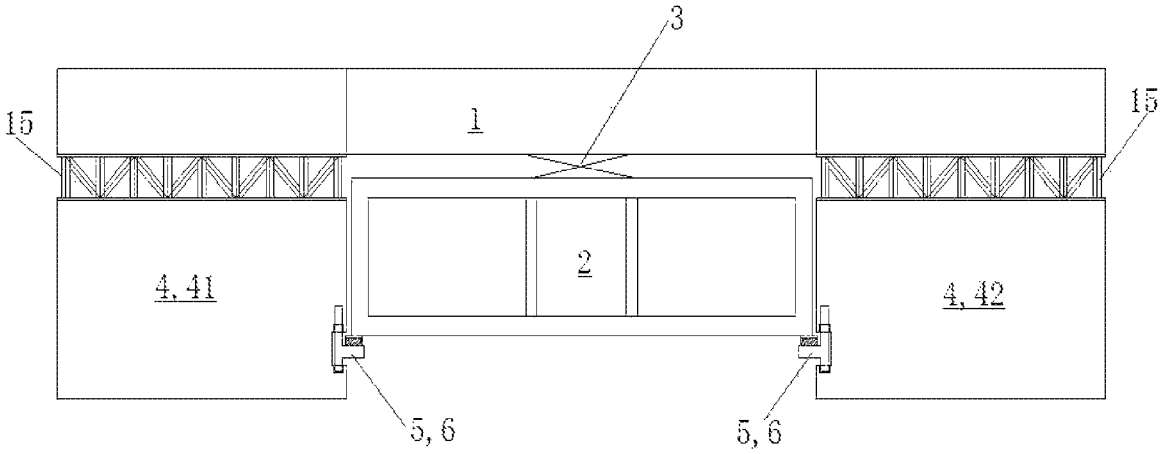
FIG. 2 is a state diagram of the integrated ship when transporting an immersed tube according to one embodiment of the present application.
Figure 3:
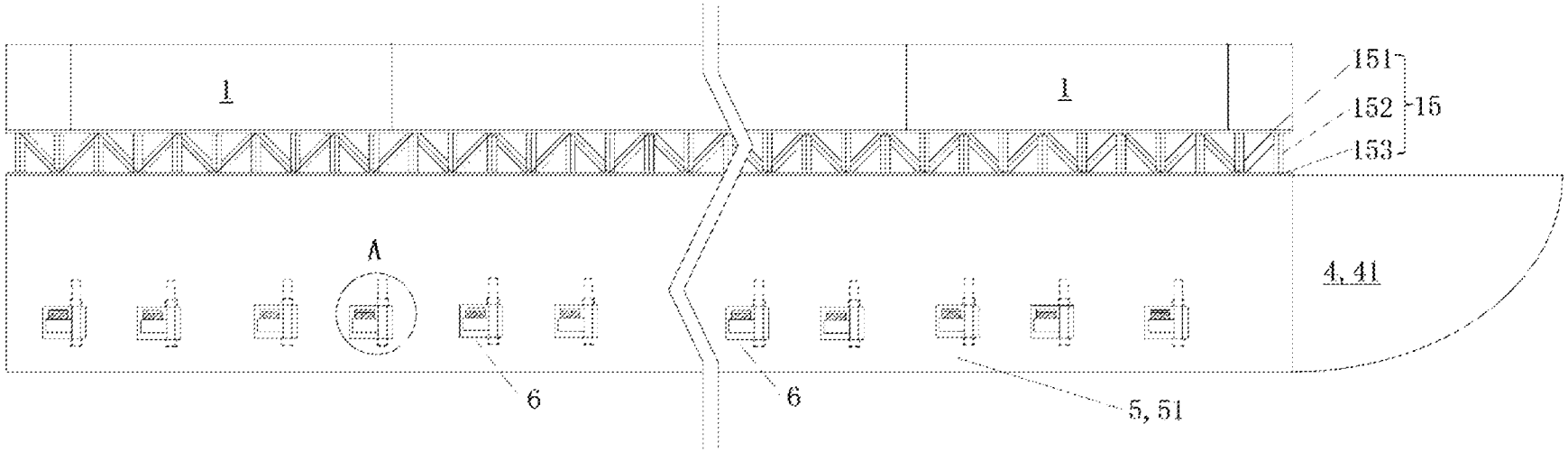
FIG. 3 is a structural diagram of a single side of the integrated ship according to one embodiment of the present application.

Each floating structure 4 can be controlled to dive down and float up by pumping ballast water in and out. Taking a vertical plane where a lengthwise centerline of the integrated ship is located as a reference plane X (as shown in FIGS. 1 and 2), the two floating structures 4 are symmetrical to the reference plane X, and upper top surfaces (or upper portions) of the two floating structures 4 are connected by the deck structure 1, as shown in FIG. 2. There may be one deck structure 1, and may also be two deck structures as shown in FIGS. 1 and 3 or more deck structures. Immersed tube installation equipment configured to install immersed tubes after arriving at the installation site may be installed on the deck structure 1. The immersed tube installation equipment adopts existing equipment, such as an installation system and an installation method thereof disclosed in CN103912013A, and immersed tube installation equipment and an installation method thereof disclosed in CN106592633A.

As shown in FIG. 1, the two support mechanisms 5 are symmetrical to the reference plane X, and each support mechanism 5 is disposed at a lower portion (or the bottom) of the corresponding floating structure 4. Each support mechanism 5 includes: at least two support assemblies 6, and drive assemblies 7 each connected to the support assembly 6 for driving the support assembly 6 to abut against or stretch out of the floating structure 4 where the support assembly 6 is located. An exemplary way in which all support assemblies 6 (13 in total) of the first support mechanism 51 are abutted against the first floating structure 41 is shown on the left side of FIG. 1, while an exemplary way in which all support assemblies 6 (13 in total) of the second support mechanism 52 stretch out of the second floating structure 42 is shown on the right side of FIG. 1. It is to be noted that the ways to abut against and stretch out as shown in FIG. 1 are merely for exemplary purposes. In practice, it is generally the case that the support assemblies 6 of the two support mechanisms are either abutted against the corresponding floating structures at the same time to hold the immersed tube to be transported or release the immersed tube transported in place, or stretch out of the corresponding floating structures at the same time to support and transport the immersed tube. When the support assemblies 6 are abutted against the floating structures 4, the distance between the support assemblies on the two floating structures 4 is greater than the width of the immersed tube 2, so as not to affect the diving process of the integrated ship above the immersed tube 2. When the support assemblies 6 stretch out of the floating structures 4, the support assemblies 6 of the two floating structures 4 can simultaneously support a bottom surface of the immersed tube 2, in this case, the space above the support assemblies 6, that below the deck structure 1 and that between the two floating structures 4 constitutes a carrying space 8 for holding the immersed tube 2.

An immersed tube transportation and installation process using the above integrated ship includes the following steps S1 to S8.

S1, after the immersed tube 2 is prefabricated, the immersed tube 2 is transported in place and is winched to a position of a submerged pit.

S2, after the immersed tube 2 is in place, the integrated ship sails to a designated position to span above the immersed tube 2.

S3, ballast water is injected into the two floating structures 4 of the integrated ship, so that the two floating structures 4 dive down synchronously to ensure the stable diving process of the integrated ship; the support assemblies 6 remain abutted against the corresponding floating structures 4 during the diving process, and the diving process ends after top surfaces of the support assemblies are lower than the bottom surface of the immersed tube.

S4, the support assemblies 6 are driven by the drive assemblies 7 to stretch out of the floating structures 4, so that the support assemblies 6 are located below the bottom surface of the immersed tube 2.

S5, the two floating structures 4 float up by discharging the ballast water simultaneously, so that the integrated ship floats up steadily; the top surfaces of the support assemblies 6 are gradually in contact with the bottom surface of the immersed tube 2 and bear force to support the immersed tube 2, the integrated ship continues to float up until the integrated ship and the immersed tube 2 as a whole meet the draught requirements of waterways, and the floating structures 4 stop discharging the ballast water.

S6, the integrated ship is towed by tugboats, and the integrated ship drives the immersed tube 2 to synchronously move therewith through friction between the support assemblies 6 and the immersed tube 2, so as to transport the immersed tube 2 to an immersed tube installation site.

S7, after the integrated ship carrying the immersed tube 2 is anchored in place, ballast water is injected into the floating structures 4 of the integrated ship, so that the integrated ship dives down synchronously and stably with the immersed tube 2. When the action force between the support assemblies 6 and the immersed tube 2 becomes zero (i.e., the buoyancy of the immersed tube 2 is equal to its gravity), and after the integrated ship continues to dive down for a short distance to ensure that the support assemblies 6 are completely detached from the bottom surface of the immersed tube 2, stop the ballast water injection and diving down; the immersed tube 2 is disconnected from the integrated ship, and the drive assembly 7 drives the support assemblies 5 to retract and abut against the floating structures 4.

S8, the two floating structures 4 float up by discharging the ballast water simultaneously, and after the integrated ship floats up to a normal position stably, an anchor cable is adjusted to winch and move the integrated ship; the immersed tube 2 is transported to the installation site by a cable system; and the immersed tube 2 is steadily lowered down by adjusting the quantity of ballast water of the immersed tube 2, adjusting the cable system and using the immersed tube installation equipment, to complete the installation of the immersed tube 2.

The integrated ship is provided with two large floating structures 4. Each floating structures 4 is internally provided with a cavity structure 43; and by controlling the quantity of water in the cavity structure 43, the floating structure 4 can be controlled to dive down and float up. More specifically, the floating structure 4 is provided with a ballast water system 14 that controls the floating structure 4 to dive down and float up by controlling the quantity of ballast water in the cavity structure 43. Conventionally, a ballast water system functions to inject ballast water into or discharge ballast water out of a ballast tank (i.e., the cavity structure), so that the ship or the immersed tube can dive down or float up. In the prior art, a ballast water system includes components, such as a ballast tank, a ballast pump, a valve box and ballast pipes etc., and is configured to pump ballast water into or out of the ballast tank through the components. The ballast water system in the present embodiment can adopt a ballast water system in the prior art.

The floating structures 4 can make the integrated ship semi-submersible by filling ballast water therein. When transporting the immersed tube, the integrated ship can provide greater buoyancy, and the support mechanisms 5 of the integrated ship can support the immersed tube 2, which can reduce the draught of the integrated ship and the immersed tube 2 as a whole in the transportation process, meet the transportation requirements of shallow waterway, greatly reduce the quantities of dredging work of the waterways, and save the construction cost. At the same time, equipment needed in the installation of immersed tubes can be installed on the deck structure 1 (i.e., the immersed tube installation equipment mentioned above), that is, the integrated ship can serve as an immersed tube installation ship and replace it, thus reduce the investment in installation, improve the operation efficiency and yield higher economic benefits.

Optionally, the integrated ship further includes a cable system disposed on each deck structure 1. The cable system may serve as at least one part of the tube-ship connecting structure 3 in the S5 to reinforce the connection between the immersed tube and the integrated ship, and may work with the immersed tube installation equipment in the S8 to install the immersed tube after arrived at the installation site.

The cable system may adopt, for example, towing and hoisting equipment disclosed in CN110877666A, including a plurality of winches, cranes, hoisting cables and other equipment, and may adopt, for example, a hoisting winch and a hoisting cable disclosed in CN107651120A.

Figure 4:
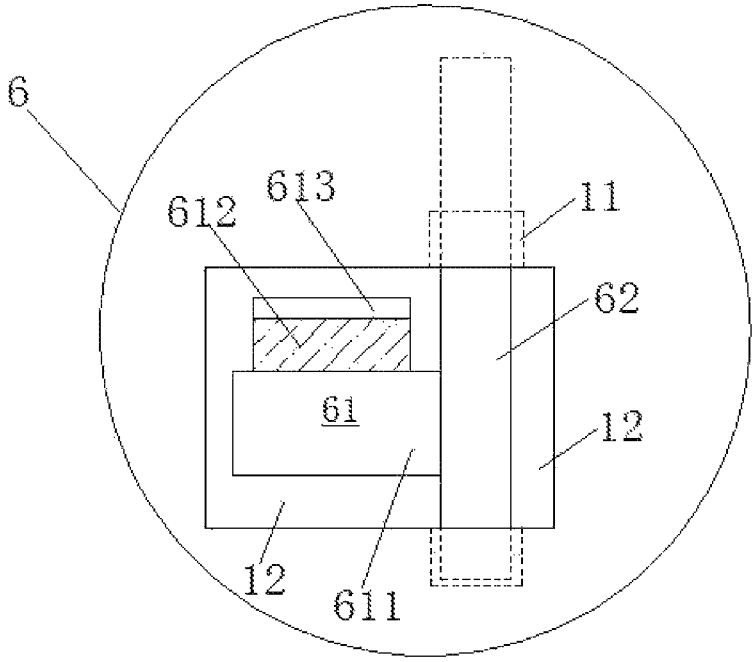
FIG. 4 is an enlarged view of Part A in FIG. 3 (accommodating state)
Figure 5:
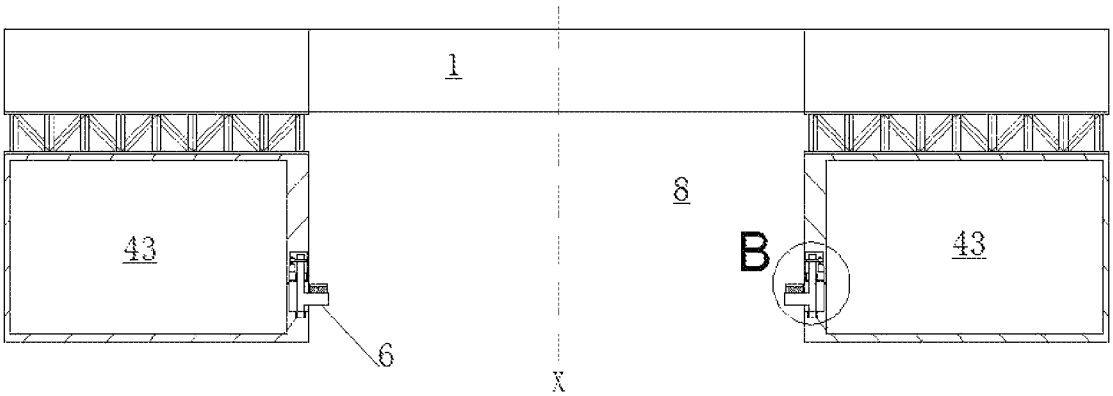
FIG. 5 is a section view of the integrated ship according to one embodiment of the present application.
Figure 6:
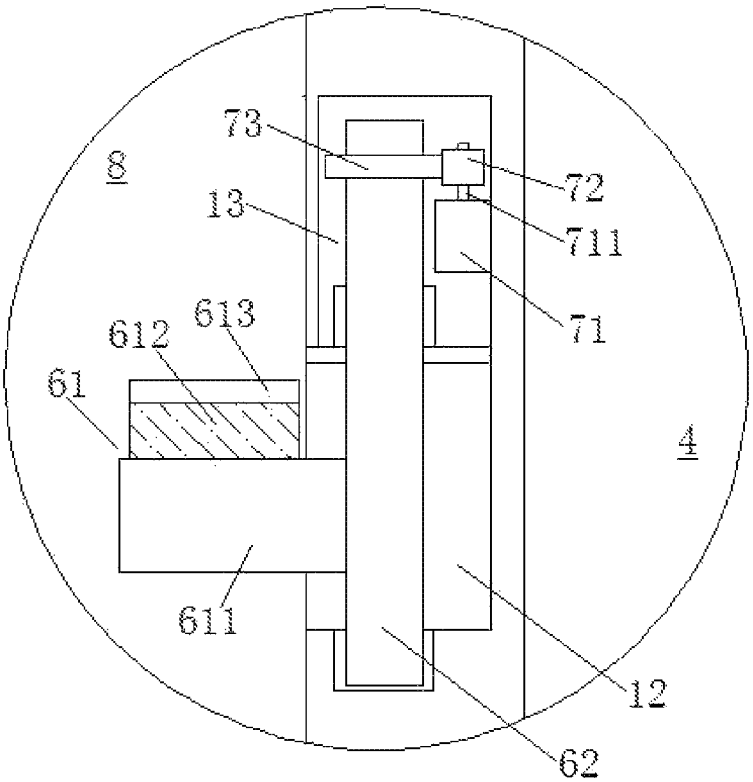
FIG. 6 is an enlarged view of Part B in FIG. 5 (outstretched state)

As an optional embodiment, the drive assemblies 7 are arranged in one-to-one correspondence with the support assemblies 6. FIGS. 4 and 6 are schematic diagrams of the support assembly 6 in one embodiment, including a support leg 61 with its top surface configured to support the immersed tube 2 and a rotating shaft 62 which is disposed vertically and configured to rotationally connect the support leg 61 and its corresponding floating structure 4. The drive assemblies 7 are disposed in one-to-one correspondence with the support legs 61 to drive the support leg 61 to rotate around the central axis of the rotating shaft 62.

As an optional embodiment, each support leg 61 is of a specific structure including: a mounting base 611 fixedly installed on a sidewall of the rotating shaft 62, and a jack 612 with its cylinder bottom fixedly installed on a top surface of the mounting base 611 and with its piston rod disposed vertically upward, and the head of the piston rod is configured to support the immersed tube 2. With the above structure, in the S5, the piston rods of the jacks 612 of multiple support legs can be adjusted to stretch out or retract back for leveling, so as to ensure the even stress between the bottom surface of the immersed tube and all support legs, and avoid the damage to the immersed tube or equipment due to partial uneven stress.

Figure 7:
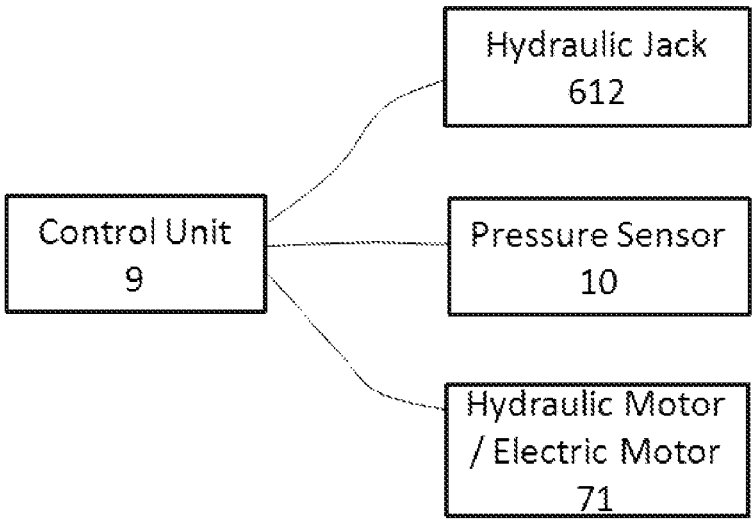
FIG. 7 is a control connection diagram of a control unit.

Since the support assemblies 6 are located at the lower portion of the integrated ship and near the water surface, in order to facilitate automatic control, as an optional embodiment, each jack 612 may be an electrically controlled hydraulic jack communicating with a remote control unit 9 (as shown in FIG. 7), and each jack 612 can be controlled by the control unit 9 to move up and down. Further, a pressure sensor 10 communicating with the control unit 9 may be provided between each jack 612 and the immersed tube 2. The control unit 9 controls each pressure sensor 10 to acquire pressure data between the corresponding jack 612 and the immersed tube 2 and transmit the acquired pressure data to the control unit 9. The control unit 9 determines whether the stress between the bottom surface of the immersed tube and each support leg is even or not based on the pressure data received, so as to control the corresponding jack 612 to move up and down for even stress. The control unit 9 may realizes the control by programming, e.g., by storing one or more related programs in a memory and executing the programs by the control unit 9. The control unit may be one or more processors, and may also be other hardware devices that can realize related functions, such as PLC, MCU, FPGA and DSP.

Optionally, a backing plate 613 is fixedly installed on the top surface of the piston rod of each jack 612, and the backing plate 613 is a rubber plate. The contact between the backing plates 613 and the immersed tube 2 to be transported can increase the friction and buffer force needed for floating transportation, improve the stability of the transportation process and protect the immersed tube.

Optionally, an end portion of the rotating shaft 62 is connected to the floating structure 4 through a bearing 11. As an optional embodiment, the drive assembly 7 may be of a structure as shown in FIGS. 4 and 6, including a hydraulic motor 71 having a drive shaft 711 vertically disposed, a first gear 72 fixedly disposed on the drive shaft 711 of the hydraulic motor, and a second gear 73 meshed with the first gear 72. The body of the hydraulic motor 71 is fixedly installed on the floating structure 4; the first gear 72 is coaxial arranged with the drive shaft 711 of the hydraulic motor; and the second gear 73 is coaxial arranged with the rotating shaft 62, and is sleeved and fixed on the rotating shaft 62, to realize the transmission between the hydraulic motor 71 and the support leg 61. With the above structure, when the hydraulic motor 71 drives the support leg 61 to rotate to a state as shown on the left side of FIG. 1 (i.e., all the support legs 61 are abutted against the corresponding floating structure 4), the distance between the support legs on the two floating structures 4 is greater than the width of the immersed tube 2, and the support legs 61 will not affect the diving process of the integrated ship above the immersed tube 2. When the hydraulic motor 71 drives the support leg 61 to rotate to a state as shown on the right side of FIG. 1 (i.e., all the support legs stretch out of the floating structure and are perpendicular to the sidewall of the floating structure), the support assemblies 6 of the two floating structures 4 can simultaneously support the bottom surface of the immersed tube 2, so as to stably support the immersed tube 2 while reducing the buoyancy needed for floating transportation.

In addition to the gear drive in the front paragraph, the drive assembly 7 may also be a electric motor directly connected with the rotating shaft 62 to directly drive the rotating shaft 62 to rotate. Regardless of whether it is driven by the hydraulic motor 71 or the electric motor, an electrically controlled manner can be applied to facilitate remote control on the one hand and to accurate control of rotation angles on the other hand. In the present embodiment, the rotation angle is defined as 0° when the support assembly is abutted against the floating structure and 90° when the support assembly stretches out of the floating structure. When the support assembly needs to stretch out of the floating structure, the control unit 9 controls the hydraulic motor 71 or the electric motor to rotate so as to drive the rotating shaft 62 to rotate to 90°. When the support assembly needs to abutted against the floating structure, the control unit 9 controls the hydraulic motor 71 or the electric motor to reversely rotate so as to drive the rotating shaft 62 to rotate to 0°. Similarly, the control unit 9 may realize the control by programming, e.g., by storing one or more related programs in a memory and executing the programs by the control unit 9. The control unit 9 may be a processor, and may also be other hardware devices that can realize related functions, such as PLC, MCU, FPGA and DSP.

Optionally, as shown in FIG. 4, a sidewall of each floating structure 4 is provided with accommodating grooves 12; the accommodating grooves 12 are in one-to-one correspondence with the support legs 61. The rotating shaft 62 is located in the corresponding accommodating groove 12, and the support leg 61 can enter the corresponding accommodating groove 12 by rotating with the rotating shaft 62 (i.e., the support leg 61 is located in the accommodating groove 12 when being abutted against the floating structure 4).

In order to facilitate the installation and protection of the drive assembly 7, as shown in FIG. 6, the floating structure 4 is internally provided with sealed electronic compartments 13 for mounting the drive assembly 7, and the sealed electronic compartments 13 are in one-to-one correspondence with the drive assemblies 7.

Optionally, the tube-ship connecting structure 3 may adopt any existing structure that can reinforce the connection between the immersed tube and the integrated ship; for example, adopting a buttress disclosed in CN107651120A to allow the frictional connection between the integrated ship and the immersed tube, and can further adopting the lashing rod to connect the integrated ship and the immersed tube. In addition, the connecting structure may also comprise the above cable system disposed on the deck structure 1, which connects the immersed tube and the integrated ship for further reinforcement.

Optionally, the rotating shaft 62 and the mounting base 611 are made of steel.

Optionally, the deck structure 1 is fixedly connected with the two floating structures 4 through detachable truss connecting structures 15. The truss connecting structure 15 allows easy disassemble and assemble between the two floating structures 4 and the deck structure 1, which facilitates hull transformation, facilitates changing the width of hull to adapt to the transportation and installation of immersed tubes 2 of different sizes, and improves the application value of the integrated ship.

Optionally, as shown in FIG. 3, the truss connecting structure 15 includes an upper connecting plate structure 151 connected to the deck structure 1, a truss structure 152, and a lower connecting plate structure 153 connected to the floating structure 4.

The embodiments are only described as preferred embodiments of the present application, and are not intended to limit the scope of the present application. Various modifications and improvements made on the technical solutions of the present application by ordinary skill in the art without departing from the design spirit of the present application shall fall within the protective scope confirmed by the claims of the present application.

The invention claimed is:

1. A semi-submersible immersed tube transportation and installation integrated ship, including:

a deck structure;

two floating structures, ballast water being able to be injected therein; taking a vertical plane where a centerline of the integrated ship along a length direction is located as a reference plane, the two floating structures are symmetrical and parallel to the reference plane, and upper portions or top surfaces of the two floating structures are connected by the deck structure; and two support mechanisms, disposed on opposite sides of the two floating structures respectively; the two support mechanisms are symmetrical to the reference plane, and each support mechanism is disposed at a lower portion or a bottom of the corresponding floating structure;

wherein, each support mechanism further includes:

at least two support assemblies; and drive assemblies each configured to drive the support assembly to abut against or stretch out of the floating structure where the support assembly is located; and the support assemblies are able to support a bottom surface of an immersed tube after stretching out of the floating structures; and a space above the support assemblies, below the deck structure and between the two floating structures constitutes a carrying space for accommodating the immersed tube.

2. The semi-submersible immersed tube transportation and installation integrated ship according to claim 1, wherein, the floating structure is internally provided with a cavity structure capable of containing ballast water; and the floating structure is provided with a ballast water system, and the ballast water system controls the floating structure to dive down and float up by controlling the quantity of ballast water in the cavity structure.

3. The semi-submersible immersed tube transportation and installation integrated ship according to claim 1, wherein, the support assembly includes: a support leg with a top surface configured to support the immersed tube, and a rotating shaft disposed vertically and configured to rotationally connect the support leg and the corresponding floating structure; and the drive assemblies are arranged in one-to-one correspondence with the support legs to drive the support leg to rotate around the rotating shaft.

4. The semi-submersible immersed tube transportation and installation integrated ship according to claim 3, wherein, an end portion of the rotating shaft is connected with the floating structure through a bearing; and the drive assembly further includes: a hydraulic motor with a body fixedly installed on the floating structure and with a drive shaft disposed vertically, a first gear being coaxially arranged with the drive shaft and being sleeved and fixed on the drive shaft, and a second gear being coaxially arranged with the rotating shaft and being sleeved and fixed on the rotating shaft; and the second gear is meshed with the first gear.

5. The semi-submersible immersed tube transportation and installation integrated ship according to claim 4, wherein, a sidewall of the floating structure is provided with accommodating grooves; the accommodating grooves are in one-to-one correspondence with the support legs; the rotating shaft is located in the corresponding accommodating groove; the support leg is able to enter into the accommodating groove by rotating with the rotating shaft; the floating structure is internally provided with sealed electronic compartments for mounting the drive assemblies; and the sealed electronic compartments are in one-to-one correspondence with the drive assemblies.

6. The semi-submersible immersed tube transportation and installation integrated ship according to claim 5, wherein, the support leg further includes: a mounting base fixedly installed on a sidewall of the rotating shaft, and a jack with a cylinder bottom fixedly installed on a top surface of the mounting base and with a piston rod disposed vertically upward.

7. The semi-submersible immersed tube transportation and installation integrated ship according to claim 6, wherein, a backing plate is fixedly installed on a top surface of the piston rod; and the backing plate is a rubber plate.

8. The semi-submersible immersed tube transportation and installation integrated ship according to claim 4, wherein, the support leg further includes: a mounting base fixedly installed on a sidewall of the rotating shaft, and a jack with a cylinder bottom fixedly installed on a top surface of the mounting base and with a piston rod disposed vertically upward.

9. The semi-submersible immersed tube transportation and installation integrated ship according to claim 8, wherein, a backing plate is fixedly installed on a top surface of the piston rod; and the backing plate is a rubber plate.

10. The semi-submersible immersed tube transportation and installation integrated ship according to claim 3, wherein, the support leg further includes: a mounting base fixedly installed on a sidewall of the rotating shaft, and a jack with a cylinder bottom fixedly installed on a top surface of the mounting base and with a piston rod disposed vertically upward.

11. The semi-submersible immersed tube transportation and installation integrated ship according to claim 10, wherein, a backing plate is fixedly installed on a top surface of the piston rod; and the backing plate is a rubber plate.

12. The semi-submersible immersed tube transportation and installation integrated ship according to claim 1, wherein, further includes a cable system disposed on the deck structure for reinforcing the connection between the immersed tube and the integrated ship.

13. The semi-submersible immersed tube transportation and installation integrated ship according to claim 1, wherein, the deck structure is fixedly connected with the two floating structures through detachable truss connecting structures; and each truss connecting structure includes an upper connecting plate connected with the deck structure, a truss structure, and a lower connecting plate connected with the floating structure.

14. A construction process for an immersed tube transportation and installation, using the semi-submersible immersed tube transportation and installation integrated ship according to claim 1, including the following steps:

transporting a prefabricated immersed tube in place and winching the immersed tube to a position of a submerged pit;

after the immersed tube in place, moving the integrated ship to a designated position to span above the immersed tube;

injecting ballast water into the floating structures of the integrated ship, so that the two floating structures dive down synchronously to ensure the stable diving of the integrated ship, and the support assemblies keep abutting against the floating structures during the diving process; and ending the diving process after top surfaces of the support assemblies are lower than the bottom surface of the immersed tube;

driving, by the drive assemblies, the support assemblies to stretch out of the floating structures, so that the support assemblies are located below the bottom surface of the immersed tube;

making the two floating structures float up by discharging the ballast water simultaneously, so that the integrated ship floats up steadily; the top surfaces of the support assemblies being gradually in contact with the bottom surface of the immersed tube and bearing force, to support the immersed tube; the integrated ship continues to float up until the integrated ship and the immersed tube as a whole meet the draught requirements of waterways; and the floating structures stop discharging the ballast water out;

towing the integrated ship by tugboats, and the integrated ship driving the immersed tube to synchronously move through friction between the support assemblies and the immersed tube, so as to transport the immersed tube to an immersed tube installation site;

after the integrated ship carrying the immersed tube is anchored in place, injecting ballast water into the floating structures of the integrated ship, so that the integrated ship dives down synchronously and stably with the immersed tube; when the action force between the support assemblies and the immersed tube becomes zero, and after the integrated ship continues to dive down for a distance to ensure that the support assemblies are completely detached from the bottom surface of the immersed tube, stopping injecting ballast water and diving down; disconnecting the immersed tube from the integrated ship; and the drive assembly driving the support assembly to retract and abut against the floating structure; and making the two floating structures float up by discharging the ballast water simultaneously; and after the integrated ship floats up to a normal position stably, adjusting an anchor cable to winch and move the integrated ship; towing the immersed tube to the installation site by a cable system; and steadily lowering the immersed tube down by adjusting the quantity of ballast water of the immersed tube and by adjusting the cable system, to complete the installation of the immersed tube.

* * * * *